US007665395B2

(12) United States Patent
Kim et al.

(10) Patent No.: US 7,665,395 B2
(45) **Date of Patent: *Feb. 23, 2010**

(54) LATERAL SUPPORT DEVICE SYSTEM FOR CANISTER-LAUNCHED MISSILE

(75) Inventors: Il-Soo Kim, Daejeon (KR); Woo-Jeon Shim, Daejon (KR); Hak-Yeol Lee, Daejeon (KR)

(73) Assignee: Agency For Defense Development, Daejeon (KR)

( * ) Notice: Subject to any disclaimer, the term of this patent is extended or adjusted under 35 U.S.C. 154(b) by 381 days.

This patent is subject to a terminal disclaimer.

(21) Appl. No.: 11/343,097

(22) Filed: Jan. 30, 2006

(65) Prior Publication Data

US 2007/0175323 A1 Aug. 2, 2007

(51) Int. Cl.
*F41F 3/04* (2006.01)

(52) U.S. Cl. ..... 89/1.816; 89/1.81; 89/1.806; 89/1.8

(58) Field of Classification Search ..... 89/1.816, 89/1.81, 1.806, 1.8
See application file for complete search history.

(56) References Cited

U.S. PATENT DOCUMENTS 3,100,421 A * 8/1963 Moy ..... 89/1.81
3,146,670 A * 9/1964 Suydam ..... 89/1.819
3,444,773 A * 5/1969 Ligne ..... 411/390
3,602,091 A 8/1971 Fryklund et al.
3,789,729 A * 2/1974 Aupy ..... 89/1.8
4,307,651 A * 12/1981 Batson et al. ..... 89/1.808
4,681,014 A * 7/1987 Gassler et al. ..... 89/1.816
4,796,510 A * 1/1989 Piesik ..... 89/1.816
5,138,951 A * 8/1992 Berville et al. ..... 102/521
5,168,119 A * 12/1992 Sands ..... 89/1.816
5,400,689 A * 3/1995 Hutter et al. ..... 89/1.816
7,484,449 B2 * 2/2009 Shim et al. ..... 89/1.816

FOREIGN PATENT DOCUMENTS

DE FR 2 572 172 A 4/1986
DE 43 04 563 C1 4/1994

* cited by examiner

*Primary Examiner*—Michelle Clement
(74) *Attorney, Agent, or Firm*—Scully, Scott, Murphy & Presser, P.C.

(57) ABSTRACT

A lateral support device system of a canister-launched missile of the present invention is provided for eliminating the clearances between missile and the canister in 4 places by 90 degrees interval, and therefore no relative movement occurs between the missile and the canister. Therefore, the missile and the detent is free from shocks and vibrations that occurs during the handling, transportation and operation. In addition, when the missile is fired, those lateral lock become free with a little energy loss.

5 Claims, 3 Drawing Sheets

LATERAL SUPPORT DEVICE SYSTEM FOR CANISTER-LAUNCHED MISSILE

BACKGROUND OF THE INVENTION

1. Field of the Invention

The present invention relates to a lateral support device system for canister-launched missile, more particularly, to a lateral support device system of a canister-launched missile for removing the clearance between a missile and a canister thereby inducing no relative movement therebetween.

2. Description of the Related Art

For all the lateral support device system for canister-launched missile developed up to the present, there always exist some clearances between the inner surface of the canister and the outer surface of missile. Therefore, some lateral movement of the missile relative to the canister occurs during the handling, transportation and operation, and the lateral movement causes the harmful effects on the missile and the missile detent.

Sabots are installed on an outer circumferential surface of the missile so that they can support the missile when the missile is insertedly installed and operated in the canister, and guide the missile within the canister when the missile is launched from the canister. The sabots allow a gap between the missile and the canister in order to prevent the missile from being caught in the canister when it is moved therein. In this respect, however, the gap causes vibrations and shocks of the missile within the canister when the missile is transported, handled and operated, and thus, resulting in a breakdown of the missile.

BRIEF DESCRIPTION OF THE INVENTION

Therefore, one object of the present invention is to provide a canister-launched missile capable of restraining a relative lateral movement of a missile within a canister when the canister-launched missile is being transported or handled and releasing the missile with negligible resistance force when it is launched.

To achieve these and other advantages and in accordance with the purpose of the present invention, as embodied and broadly described herein, there is provided a lateral support device system for a canister-launched missile comprising: sabots separably formed on an outer circumferential surface of a missile; travel lock bar which is integrally fixed to the sabots; and travel lock bolt fixed at the canister and selectively pressing the upper end of the travel lock bar.

Herein, a groove is formed on the upper surface of the sabots in the direction of the missile launching, and the travel lock bar is fixed to the sabot so that the upper end of the travel lock bar is located below the upper surface of the sabots.

The lateral support device system further comprises: a position adjustment pin fixed at the bottom surface of the sabot so as to be inserted in a position adjustment recess formed on the outer circumferential surface of the missile, and a spring installed and compressed inside the sabot and allowing the position adjustment pin to be pressed and inserted in the position adjustment recess of the missile.

The lateral support device system further including a spring seat having a convex portion at one end for accommodating one end of the spring and having a portion at the other end for fixing the a position adjustment pin.

A load support plate is formed between the bottom surface of the sabot and the outer circumferential surface of the missile, so that when the travel lock bolt presses the sabot, the load support plate contacts with the outer circumferential surface of the missile.

A plurality of sabots and a plurality of travel lock bolts are formed at certain intervals on the outer circumferential surface of the missile.

On the other hand, the present invention provides a lateral support device system for a canister-launched missile comprising: sabots formed on an outer circumferential surface of a missile; travel lock bar which is integrally fixed to the sabots; and travel lock bolt fixed at the canister and selectively pressing the upper surface of the sabots.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
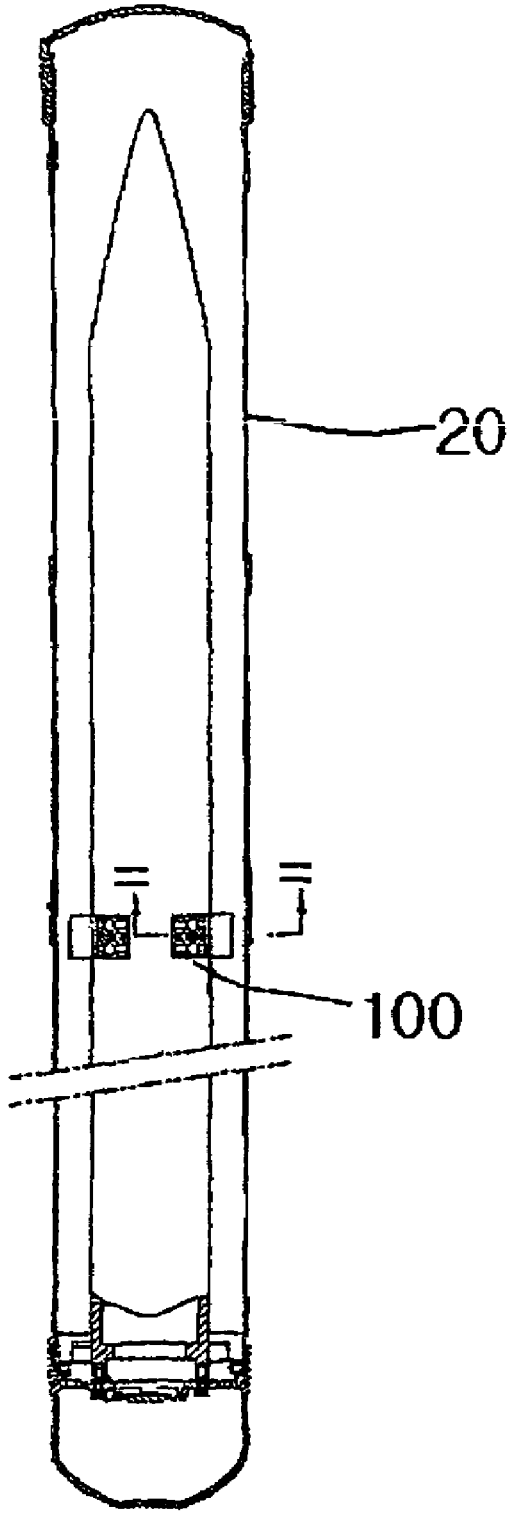
FIG. 1 is a side perspective view of a canister-launched missile including a lateral support device system in accordance with the present invention.
Figure 2:
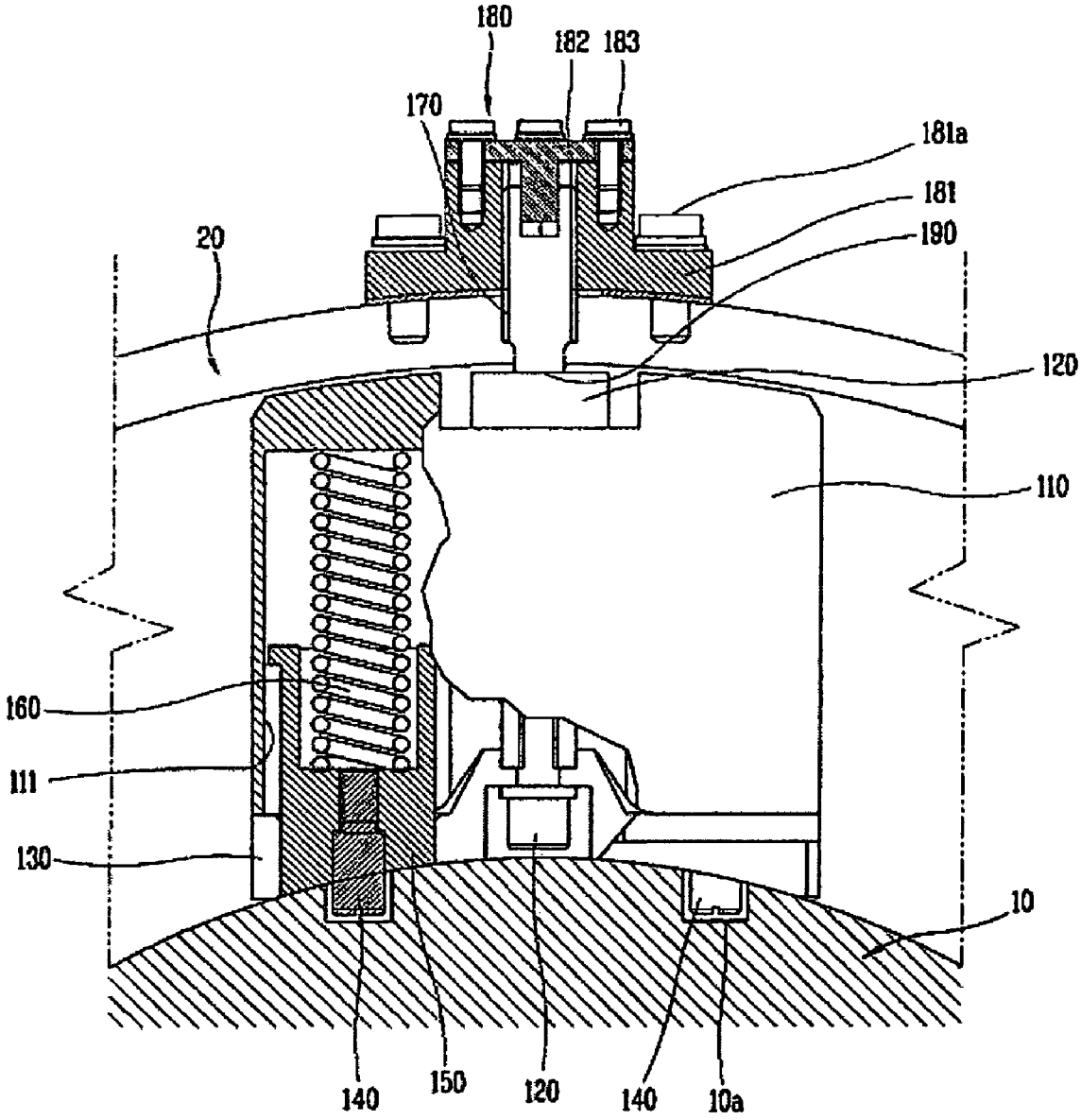
FIG. 2 is a sectional view taken along line II-II of FIG. 1.

The present invention will now be described in detail with reference to the accompanying drawings.

In describing the present invention, detailed descriptions with respect to a known function or construction will be omitted to make the gist of the present invention clear. The construction of the lateral support device system 100 in accordance with the present invention will be described in detail.

The lateral support device system 100 includes sabots 110 protruded from the side of an outer circumference of the missile 10; a travel lock bar 120 formed inside the sabot 110; a load support plate 130 formed to cover the circumference of the bottom of the sabot 110 and contacting with the outer circumferential surface of the missile 10 when a certain load is applied to the sabot 110; a position adjustment pin 140 is fixed to the spring seat 150 and inserted in a position adjustment recess 10*a* formed on an outer circumferential surface of the missile 10; a spring seat 150 for receiving a portion of the position adjustment pin 140 at one end thereof; a spring 160 installed to be compressed between a receiving portion formed at the other end of the spring seat 150 and an inner surface of the sabot 110; a travel lock bolt 170 installed to press the upper end of the travel lock bar 120 of the sabot 110 with a certain load; and a lock bolt fixture 180 for fixing the travel lock bolt 170 and helping transfer of the travel took bolt 170.

The sabot 110 is formed as a sabot body 111 with a hollow portion formed therein, and installed not to be fixed on the outer circumferential surface of the missile 10 but to contact therewith.

When the travel lock bolt 170 is fixed at the lock bolt fixture 180 and transferred in the direction of the missile 10 to press the front end of the travel lock bar 120 of the sabot 110, the load support plate 130 is pressed by the bottom of the circumference of the sabot body 111 and tightly attached with the outer circumferential surface of the missile 10.

The position adjustment pin 140 has thread on one end and is fastened to the other end of the spring seat 150. And the other end of the position adjustment pin 140 inserted in the position adjustment recess 10*a* of the missile 10, rather than being fastened in the recess. Therefore, although the depth of the recess is different from other one, as the position adjustment pin is fixed to the spring seat 150, the position adjustment pin 140 can be inserted into the recess with the constant depth.

One end of the spring seat 150 includes a convex portion for accommodating the one end of the spring 160 and a receiving portion for fixing the position adjustment pin 140.

A contact surface 190 of the travel lock bolt 170 pressed by a certain force contacts with a front end of the travel lock bar 120 of the sabot 110, which is not fixed at the travel lock bar 120. Accordingly, as the missile 10 is launched in the canister 20, the frictional restriction condition between the travel lock bolt 170 and the travel lock bar 120 is smoothly released.

Accordingly, when the missile 10 is launched by force overcoming the frictional force between the travel lock bolt 170 and the travel lock bar 120, the constraint according to the frictional force between the travel lock bolt 170 and the travel lock bar 120 is naturally released according to the launching thrust of the missile 10.

The lock bolt fixture 180 includes a fixing portion 181 having a screw thread formed at the center thereof and fastened with the outer circumferential surface of the canister 20 with a fixing bolt 181*a*, an adjusting portion 182 having a protrusion to be inserted into a polygonal recess formed on a front end of the travel lock bolt 170, and a position fixing bolt 183 for rotating the travel lock bolt 170 by using the adjusting portion 182 and fastening the adjusting portion 182 and the fixing portion 181.

Figure 3:
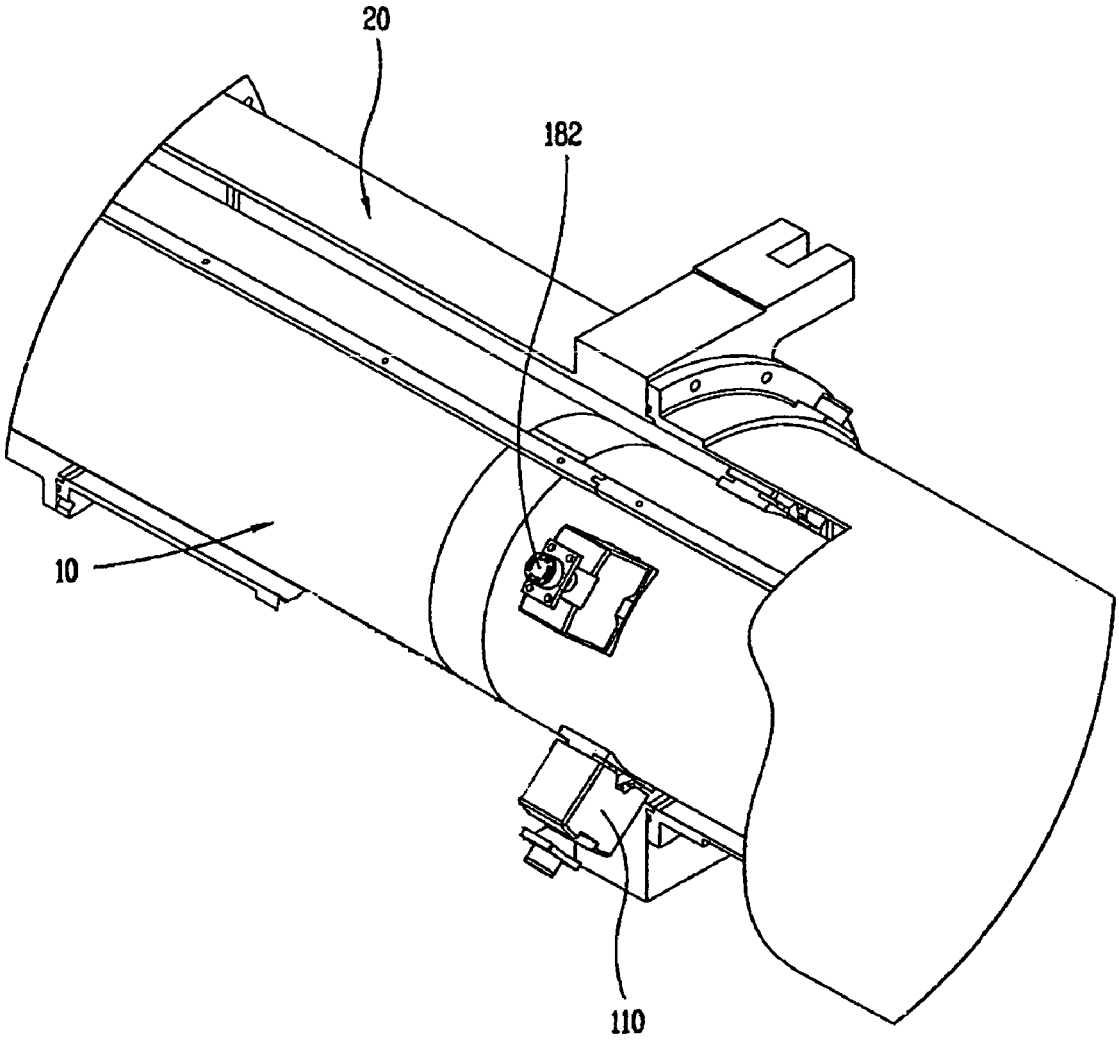
FIG. 3 is a perspective view showing the shape that the construction of FIG. 2 is mounted in the missile.

As shown in FIG. 3, the lateral support device system 100 is formed at four positions by 90° intervals on the outer circumferential surface of the missile 10 and protects the missile 10 such that when the missile 10 mounted within the canister 20 is moved (fluctuated) in the lateral direction when being handled, transported and operated, a relative movement between the canister 20 and the missile 10 may not occur.

Namely, in order not to allow formation of a gap between the outer circumferential surface of the sabot 110 and the inner surface of the canister 20, the travel lock bolt 170 is installed at the lock bolt fixture 180, which is fastened to strongly press the travel lock bar 120 provided at the center of the sabot 110 to make the load support plate 140 contact with the outer circumferential surface of the missile 10.

The sabots 110 are supportedly installed at the outer circumferential surface of the missile 10 at 90° intervals not to allow formation of a gap between the canister 20 and the missile 10 before the missile is launched. When the missile 10 starts to be launched, the missile 10 caught by the sabots 110 by means of the position adjustment pin 140 proceeds together with the sabots 110 within the canister 20, overcoming the frictional force generated by a load in an axial direction between the travel lock bolt 170 and the travel lock bar 120. Then, the contact state between the travel lock bolt 170 and the travel lock bar 120 is released, and accordingly, the outer circumferential surface of the sabot body 111 is slid in a state of contacting with the inner surface of the canister 20 by virtue of the spring 160 and the spring seat 150. At the moment the missile 10 blasts off after being highly accelerated within the canister 20, the sabots 110 scatter in all directions by a restoration force of the compressed spring 160.

As stated above, the scope of the present invention is not limited to the above-described specific embodiment of the present invention but can be modified suitably within the coverage of the claims. For example, without installing an travel lock bar 120 in the sabots, the travel lock bolt can contact directly with the upper surface of the sabot so as to remove the clearance between the missile and the canister.

As so far described, a lateral support device system of a canister-launched missile in accordance with the present invention has the following advantages.

That is, by installing sabots separably formed on the outer circumferential surface of the missile and the travel lock bolt fixed at the canister and selectively pressing a front end surface of the sabots so as to contact with the sabots, with the missile placed inside the canister before being launched, no gap is formed between the canister and the missile even without an additional protrusion or unit, so that an impact that may be applied to the missile can be restrained to the maximum and thus the missile can be stably fixed in the lateral direction.

Moreover, after the missile is launched from the canister, the sabots can be automatically separated from the missile without using an additional unit.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, to and therefore all changes and modifications that fall within the metes and bounds of the claims, or equivalence of such metes and bounds are therefore intended to be embraced by the appended claims.

What is claimed is:

1. A lateral support device system for a canister-launched missile comprising:

sabots being formed in peripherally spaced relationships on an outer circumferential surface of a missile;

travel lock bars being integrally fixed to respectively each of the sabots; and travel lock bolts fixed to a canister and selectively pressing ends of the respective travel lock bars towards the canister so as to be in contact with the therewith associated travel lock bars;

position adjustment pins being fixed to surfaces of the respective sabots, the surfaces being disposed to face the outer circumferential surface of the missile, so as to be insertable into position adjustment recesses formed on the outer circumferential surface of the missile; and a spring being installed and compressed inside each said sabot, for facilitating the position adjustment pin to be pressed and inserted into the position adjustment recess of the mistake.

2. The system of claim 1, further comprising:

a spring seat having a concave portion at one end for accommodating one end of the spring and having a portion at an opposite end for fixing each respective said position adjustment pin.

3. The system of claim 1, further comprising:

a load support plate being formed between the bottom surface of each said sabot and the outer circumferential surface of the missile, so that upon the respective travel lock bolt pressing against the therewith associated sabot, the load support plate contacts the outer circumferential surface of the missile.

4. The system of claim 2, wherein a plurality of said sabots and a plurality of said travel lock bolts are formed at predetermined peripherally spaced intervals on the outer circumferential surface of the missile.

5. A lateral support device system for a canister-launched missile comprising:

sabots being formed on an outer circumferential surface of a missile; and travel lock bolts fixed to a canister and selectively pressing surfaces of the respective sabots towards the canister so as to be in contact with the sabots;

position adjustment pins being fixed to surfaces of the respective sabots, the surfaces being disposed to face the outer circumferential surface of the missile, so as to be insertable into position adjustment recesses formed on the outer circumferential surface of the missile; and a spring being installed and compressed inside each said sabot for facilitating the position adjustment pin to be pressed and inserted into the position adjustment recess of the missile.

* * * * *